US006733943B2

(12) United States Patent
Finn et al.

(10) Patent No.: US 6,733,943 B2
(45) Date of Patent: May 11, 2004

(54) PRESSURE BELT HAVING POLYIMIDE OUTER LAYER

(75) Inventors: Patrick J. Finn, Webster, NY (US); Robert S. Pawlik, Webster, NY (US); Elizabeth L. Barrese, Rochester, NY (US); David J. Gervasi, West Henrietta, NY (US); Pat Goode, Macedon, NY (US); Santokh S. Badesha, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 107 days.

(21) Appl. No.: 09/948,522

(22) Filed: Sep. 7, 2001

(65) Prior Publication Data

US 2003/0049056 A1 Mar. 13, 2003

(51) Int. Cl.[7] ..... G03G 13/20

(52) U.S. Cl. ..... 430/124; 399/333; 399/339; 428/473.5

(58) Field of Search ..... 430/124; 399/333, 399/339; 428/473.5

(56) References Cited

U.S. PATENT DOCUMENTS

| | | | | | |
|---|---|---|---|---|---|
| 4,150,181 | A | * | 4/1979 | Smith | 427/444 |
| 4,411,977 | A | | 10/1983 | Tarumi et al. | 430/126 |
| 5,035,950 | A | | 7/1991 | Del Rosario | 428/421 |
| 5,532,056 | A | | 7/1996 | Satoh et al. | 428/332 |
| 5,641,568 | A | | 6/1997 | Satoh et al. | 428/332 |
| 5,709,949 | A | | 1/1998 | Chen et al. | 428/421 |
| 5,759,655 | A | | 6/1998 | Kitajima et al. | 428/36.91 |
| 5,763,129 | A | | 6/1998 | Chen et al. | 430/99 |
| 5,853,892 | A | | 12/1998 | Chen et al. | 428/421 |
| 5,855,977 | A | | 1/1999 | Fukushi et al. | 428/36.6 |
| 5,906,881 | A | | 5/1999 | Chen et al. | 428/141 |
| 5,948,491 | A | | 9/1999 | Chen et al. | 428/35.7 |
| 6,001,440 | A | | 12/1999 | Miyamoto et al. | 428/36.9 |
| 6,002,910 | A | * | 12/1999 | Eddy et al. | 399/329 |
| 6,007,918 | A | | 12/1999 | Tan et al. | 428/451 |
| 6,010,791 | A | | 1/2000 | Tan et al. | 428/451 |
| 6,066,400 | A | | 5/2000 | Law et al. | 428/412 |
| 6,074,574 | A | | 6/2000 | Chen et al. | 252/183.11 |
| 6,074,719 | A | | 6/2000 | Fukushi et al. | 428/36.9 |
| 6,096,427 | A | | 8/2000 | Chen et al. | 428/412 |
| 6,201,945 | B1 | * | 3/2001 | Schlueter et al. | 399/329 |
| 6,217,963 | B1 | | 4/2001 | Miyamoto et al. | 428/36.91 |
| 6,284,373 | B1 | * | 9/2001 | Ream et al. | 428/379 |

* cited by examiner

*Primary Examiner*—Mark A. Chapman
(74) *Attorney, Agent, or Firm*—Annette L. Bade

(57) ABSTRACT

A pressure belt useful in electrostatographic machines, having a polyimide substrate, an optional intermediate and/or adhesive layer, and an outer polyimide layer.

24 Claims, 4 Drawing Sheets

PRESSURE BELT HAVING POLYIMIDE OUTER LAYER

Attention is directed to application U.S. patent application Ser. No. 08/921,133, filed Aug. 29, 1997, entitled, "Fluorinated Carbon Filled Polyimide Intermediate Transfer Component;" and U.S. patent application Ser. No. 09/948,524, filed Sep. 7, 2001, entitled, "Fuser Member having High Temperature Plastic Outer Layer." The disclosures of each of these applications are hereby incorporated by reference in their entirety.

BACKGROUND OF THE INVENTION

The present invention relates generally to an imaging apparatus and fuser components thereof for use in electrostatographic, including digital, apparatuses. The fuser components, including fuser members, pressure member, donor members, external heat member, and the like, are useful for many purposes including fixing a toner image to a copy substrate. More specifically, the present invention relates to fuser components comprising a polyimide outer layer. In embodiments, the polyimide outer layer is positioned on a substrate, which may be of many configurations including a roller, belt, film, or like substrate. In other embodiments, the polyimide outer layer has an outer release layer thereon. In embodiments, there is positioned between the substrate and the outer polyimide layer, an intermediate and/or adhesive layer. In embodiments, the fuser member is a pressure member, such as a pressure belt. The present invention may be useful as fuser members in xerographic machines, including color machines.

In a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. The visible toner image is then in a loose powdered form and can be easily disturbed or destroyed. The toner image is usually fixed or fused upon a support, which may be the photosensitive member itself, or other support sheet such as plain paper.

The use of thermal energy for fixing toner images onto a support member is well known and methods include providing the application of heat and pressure substantially concurrently by various means, a roll pair maintained in pressure contact, a belt member in pressure contact with a roll, a belt member in pressure contact with a heater, and the like. Heat may be applied by heating one or both of the rolls, plate members, or belt members. With a fixing apparatus using a thin film in pressure contact with a heater, the electric power consumption is small, and the warming-up period is significantly reduced or eliminated.

It is important in the fusing process that minimal or no offset of the toner particles from the support to the fuser member take place during normal operations. Toner particles offset onto the fuser member may subsequently transfer to other parts of the machine or onto the support in subsequent copying cycles, thus increasing the background or interfering with the material being copied there. The referred to "hot offset" occurs when the temperature of the toner is increased to a point where the toner particles liquefy and a splitting of the molten toner takes place during the fusing operation with a portion remaining on the fuser member. The hot offset temperature or degradation of the hot offset temperature is a measure of the release property of the fuser, and accordingly it is desired to provide a fusing surface, which has a low surface energy to provide the necessary release. To ensure and maintain good release properties of the fuser, it has become customary to apply release agents to the fuser roll during the fusing operation. Typically, these materials are applied as thin films of, for example, silicone oils to prevent toner offset.

Another important method for reducing offset, is to impart antistatic and/or field assisted toner transfer properties to the fuser. However, to control the electrical conductivity of the release layer, the conformability and low surface energy properties of the release layer are often affected.

U.S. Pat. No. 5,411,779 to Nakajima et al. discloses a composite tubular article for a fusing belt comprising a tubular inner layer of polyimide and fluoroplastic outer layers.

U.S. Pat. No. 5,309,210 to Yamamoto discloses a belt apparatus comprising a base layer polyimide and a fluorine resin outer layer.

U.S. Pat. No. 5,149,941 to Hirabayashi and U.S. Pat. No. 5,196,675 to Suzuki, both disclose an image fixing apparatus comprising an electrically insulating material base layer and low resistance surface layer insulating member comprised of a polyimide.

U.S. Pat. No. 5,532,056 teaches a fixing belt comprised of a polyimide resin.

U.S. Pat. No. 6,066,400 discloses biasable components comprising polyimides.

U.S. Pat. No. 5,761,595 discloses intermediate transfer components having a polyimide substrate and a fluorinated carbon filled fluoropolymer layer.

U.S. Pat. No. 6,201,945 discloses polyimide fuser components having doped metal oxides dispersed therein.

Known fuser coatings include high temperature polymers such as polytetrafluoroethylene, perfluoroalkoxy, fluorinated ethylene propylene, silicone rubber, fluorosilicone rubber, fluoroelastomers, and the like. These coatings have been found to have adequate release properties and control toner offset sufficiently. However, these coatings do not tend to stay clean during use. Further, the coatings do not maintain a uniform surface. More specifically, the coatings often wear during use and/or become scratched during operation. In addition, these known surfaces often react with the toner and/or oil and/or debris from media, which causes the surface to become dirty and/or contaminated. The surface can, in turn, become physically damaged. The result of these problems is that the fuser member has a reduced useful function and short life. Another problem resulting from release coatings with high friction is unacceptable copy or print quality defects. The high friction often associated with conformable coatings may result in the generation of waves in the media being fused and/or the fuser member itself. This, in turn, results in copies or prints with localized areas of poorer fix and/or differential gloss.

Therefore, a need remains for fuser components for use in electrostatographic machines that have superior mechanical properties, including a the ability to remain clean and uniform during use. A further need remains for fuser coatings having reduced susceptibility to contamination, scratching, and other damage. In addition, a need remains for a fuser component having a longer life. In addition, a need remains for a fuser component with low friction while being resistant to scratching and other damage.

SUMMARY OF THE INVENTION

The present invention provides, in embodiments, a fuser component comprising a substrate, and thereover, an outer layer comprising a polyimide.

The present invention further includes, in embodiments, a pressure belt comprising a polyimide substrate, and thereover, an outer layer comprising a polyimide.

Moreover, the present invention provides, in embodiments, a fuser member comprising a substrate and thereover, an outer layer comprising a polyimide and filler, wherein the filler is selected from the group consisting of polytetrafluoroethylene powder, copper oxide, and mixtures thereof.

In addition, the present invention provides, in embodiments, an image forming apparatus for forming images on a recording medium comprising a charge-retentive surface to receive an electrostatic latent image thereon; a development component to apply toner to the charge-retentive surface to develop an electrostatic latent image to form a developed image on the charge retentive surface; a transfer film component to transfer the developed image from the charge retentive surface to a copy substrate; and a fusing component for fusing toner images to a surface of the copy substrate, the fusing component comprising a substrate, and thereover an outer layer comprising a polyimide.

BRIEF DESCRIPTION OF THE DRAWINGS

The above embodiments of the present invention will become apparent as the following description proceeds upon reference to the drawings, which include the following figures.

DETAILED DESCRIPTION OF THE INVENTION

The present invention is directed to fuser components, and in particular, fusing components including fuser members; pressure members; donor members such as release agent donor members, release agent metering members, and the like; transfix or transfuse members; external heat members; cleaning members; and the like. In an embodiment of the present invention, the fuser component comprises a substrate and an outer layer comprising a polyimide. In another embodiment, the fuser component comprises a substrate having an outer layer comprising a polyimide thereon, and having an outer release layer on the polyimide outer layer. In embodiments, optional adhesive and/or intermediate layers can be present between the substrate and the outer polyimide layer, and/or between the polyimide outer layer and the outer release layer. In embodiments, the polyimide outer layer contains low surface energy fillers. In other embodiments, the substrate also comprises a polyimide. In embodiments, the fuser member is a pressure belt.

Figure 1:
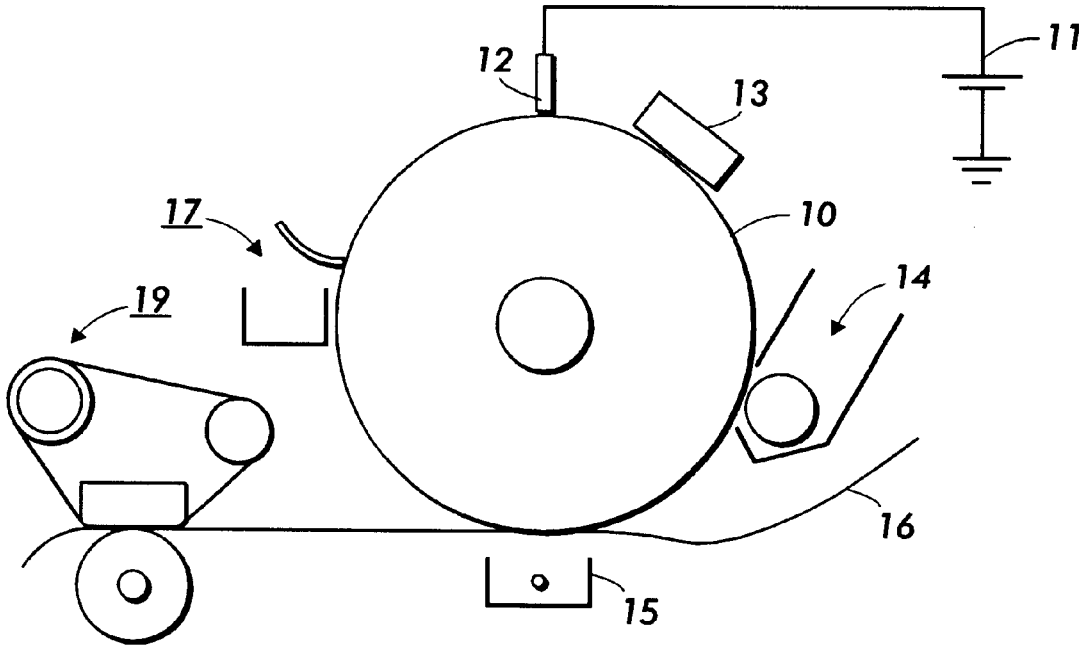
FIG. 1 is an illustration of a general electrostatographic apparatus.

Referring to FIG. 1, in a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. Specifically, photoreceptor 10 is charged on its surface by means of a charger 12 to which a voltage has been supplied from power supply 11. The photoreceptor is then imagewise exposed to light from an optical system or an image input apparatus 13, such as a laser and light emitting diode, to form an electrostatic latent image thereon. Generally, the electrostatic latent image is developed by bringing a developer mixture from developer station 14 into contact therewith. Development can be effected by use of a magnetic brush, powder cloud, or other known development process. A dry developer mixture usually comprises carrier granules having toner particles adhering triboelectrically thereto. Toner particles are attracted from the carrier granules to the latent image forming a toner powder image thereon. Alternatively, a liquid developer material may be employed, which includes a liquid carrier having toner particles dispersed therein. The liquid developer material is advanced into contact with the electrostatic latent image and the toner particles are deposited thereon in image configuration.

After the toner particles have been deposited on the photoconductive surface, in image configuration, they are transferred to a copy sheet 16 by transfer means 15, which can be pressure transfer or electrostatic transfer. Alternatively, the developed image can be transferred to an intermediate transfer member and subsequently transferred to a copy sheet.

After the transfer of the developed image is completed, copy sheet 16 advances to fusing station 19, depicted in FIG. 1 as fusing and pressure rolls, wherein the developed image is fused to copy sheet 16 by passing copy sheet 16 between the fusing and pressure members, thereby forming a permanent image. Photoreceptor 10, subsequent to transfer, advances to cleaning station 17, wherein any toner left on photoreceptor 10 is cleaned therefrom by use of a blade (as shown in FIG. 1), brush, or other cleaning apparatus.

Figure 2:
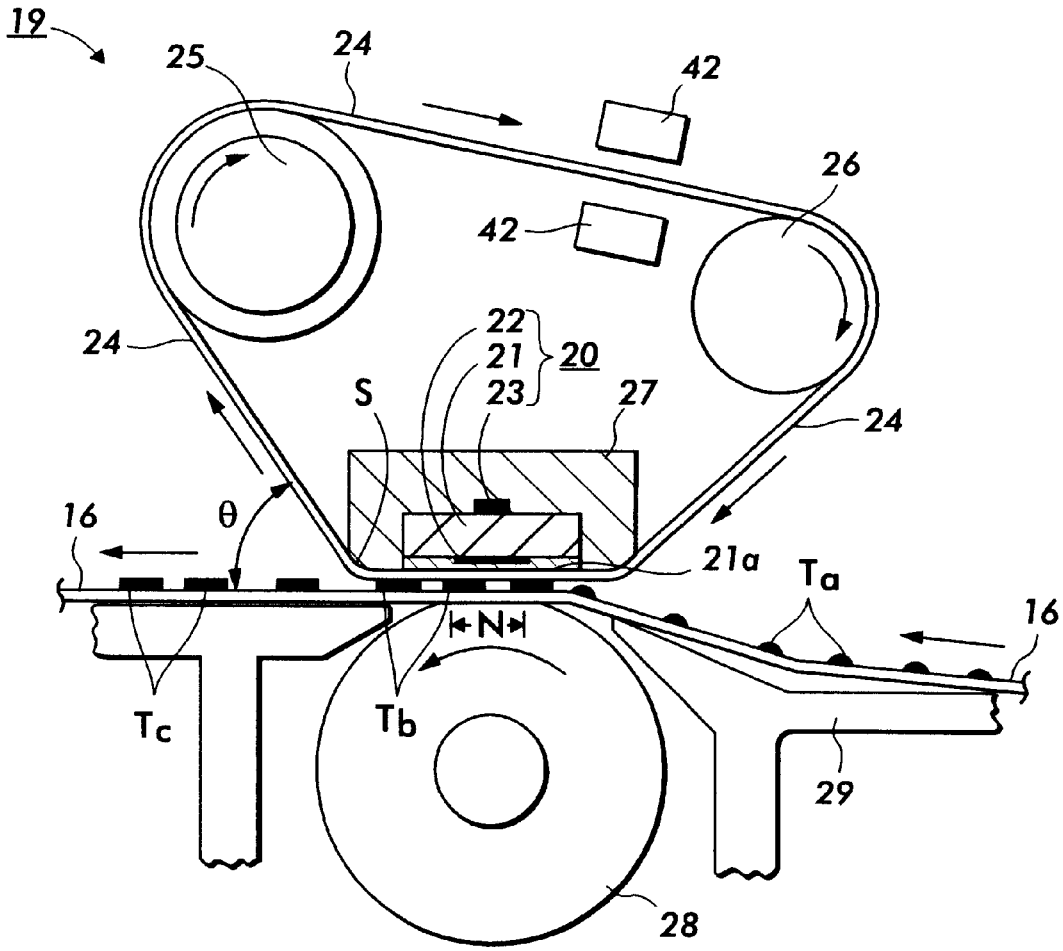
FIG. 2 is a sectional view of a fusing belt in accordance with one embodiment of the present invention.

FIG. 2 shows a sectional view of an example of a fusing apparatus 19 according to an embodiment of the present invention. In FIG. 2, a heat resistive film or an image fixing film 24 in the form of an endless belt is trained or contained around three parallel members, that is, a driving roller 25, a follower roller 26 of metal and a low thermal capacity linear heater 20 disposed between the driving roller 25 and the follower roller 26.

The follower roller 26 also functions as a tension roller for the fixing film 24. The fixing film rotates at a predetermined peripheral speed in the clockwise direction by the clockwise rotation of the driving roller 25. The peripheral speed is the same as the conveying speed of the sheet having an image thereon so that the film is not creased, skewed or delayed.

A pressing roller 28 has a rubber elastic layer with parting properties, such as silicone rubber or the like, and is press-contacted to the heater 20 with the bottom travel of the fixing film 24 therebetween. The pressing roller is pressed against the heater at the total pressure of 4–7 kg by an urging means (not shown). The pressure roller rotates co-directionally, that is, in the counterclockwise direction, with the fixing film 24.

The heater 20 is in the form of a low thermal capacity linear heater extending in a direction crossing with the film 24 surface movement direction (film width direction). It comprises a heater base 27 having a high thermal conductivity, a heat generating resistor 22 generating heat upon electric power supply thereto, and a temperature sensor 23, and is mounted on a heater support 21 having high thermal conductivity.

The heater support 21 supports the heater 20 with thermal insulation on an image fixing apparatus and is made from high heat durability resin such as PPS (polyphenylene sulfide), PAI (polyamideimide), PI (polyimide), polyaramide, polyphthalamide, polyketones, PEEK (polyether ether ketone) or liquid crystal polymer material, or a compound material of such resin material and ceramics, metal, glass or the like material.

An example of the heater base 27 is in the form of an alumina plate having a thickness of 1.0 mm, a width of 10 mm and a length of 240 mm comprised of a high conductivity ceramic material.

The heat generating resistor material 22 is applied by screen printing or the like along a longitudinal line substantially at the center, of the bottom surface of the base 27. The heat generating material 22 is, for example, Ag/Pd (silver palladium), $Ta_2N$ or another electric resistor material having a thickness of approximately 10 microns and a width of 1–3 mm. It is coated with a heat resistive glass 21*a* in the thickness of approximately 10 microns, as a surface protective layer. A temperature sensor 23 is applied by screen printing or the like substantially at a center of a top surface of the base 27 (the side opposite from the side having the heat generating material 22). The sensor is made of Pt film having low thermal capacity. Another example of the temperature sensor is a low thermal capacity thermistor contacted to the base 27.

The linear or strip heater 22 is connected with the power source at the longitudinal opposite ends, so that the heat is generated uniformly along the heater. The power source in this example provides AC 100 V, and the phase angle of the supplied electric power is controlled by a control circuit (not shown) in accordance with the temperature detected by the temperature detecting element 23.

A film position sensor 42 in the form of a photocoupler is disposed adjacent to a lateral end of the film 24. In response to the output of the sensor, the roller 26 is displaced by a driving means in the form of a solenoid (not shown), so as to maintain the film position within a predetermined lateral range.

Upon an image formation start signal, an unfixed toner image is formed on a recording material at the image forming station. The copy sheet 16 having an unfixed toner image Ta thereon is guided by a guide 29 to enter between the fixing film 24 and the pressing roller 28 at the nip N (fixing nip) provided by the heater 20 and the pressing roller 28. Copy sheet 16 passes through the nip between the heater 20 and the pressing roller 28 together with the fixing film 24 without surface deviation, crease or lateral shifting while the toner image carrying surface is in contact with the bottom surface with the fixing film 24 moving at the same speed as copy sheet 16. The heater 20 is supplied with electric power at a predetermined timing after generation of the image formation start signal so that the toner image is heated at the nip so as to be softened and fused into a softened or fused image Tb.

Fixing film 24 is sharply bent at an angle theta of, for example, about 45 degrees at an edge S (the radius of curvature is approximately 2 mm), that is, the edge having a large curvature in the heater support 21. Therefore, the sheet advanced together with the film 24 in the nip is separated by the curvature from the fixing film 24 at edge S. Copy sheet 16 is then discharged to the sheet discharging tray. By the time copy sheet 16 is discharged, the toner has sufficiently cooled and solidified and therefore is completely fixed (toner image Tc).

In this embodiment, heat generating element 22 and base 27 of heater 20 have low thermal capacity. In addition, heater element 22 is supported on support 21 through thermal insulation. The surface temperature of heater 20 in the nip quickly reaches a sufficiently high temperature, which is necessary in order to fuser, the toner. Also, a stand-by temperature control is used to increase the temperature of the heater 20 to a predetermined level. Therefore, power consumption can be reduced, and rise in temperature can be prevented.

The fixing film is in contact with the heater. The distance between the outer layer of the fixing film and the heater is preferably from about 0.5 mm to about 5.0 mm. Similarly, the distance between the fixing film and the grounded rollers 25 and 26 is not less than about 5 mm and is, for example, from about 5 to about 25 mm. These distances prevent leakage of the charge applied to the copy sheet 16 by an image (not shown) forming station from leaking to the ground through the copy sheet 16. Therefore, possible deterioration of image quality due to improper image transfer can be avoided, or minimized.

In another embodiment of the invention, the fixing film may be in the form of a sheet. For example, a non-endless film may be rolled on a supply shaft and taken out to be wrapped on a take-up shaft through the nip between the heater and the pressing roller. Thus, the film may be fed from the supply shaft to the take-up shaft at the speed, which is equal to the speed of the transfer material, reference U.S. Pat. No. 5,157,446, the disclosure of which is hereby incorporated by reference in its entirety.

Figure 3:
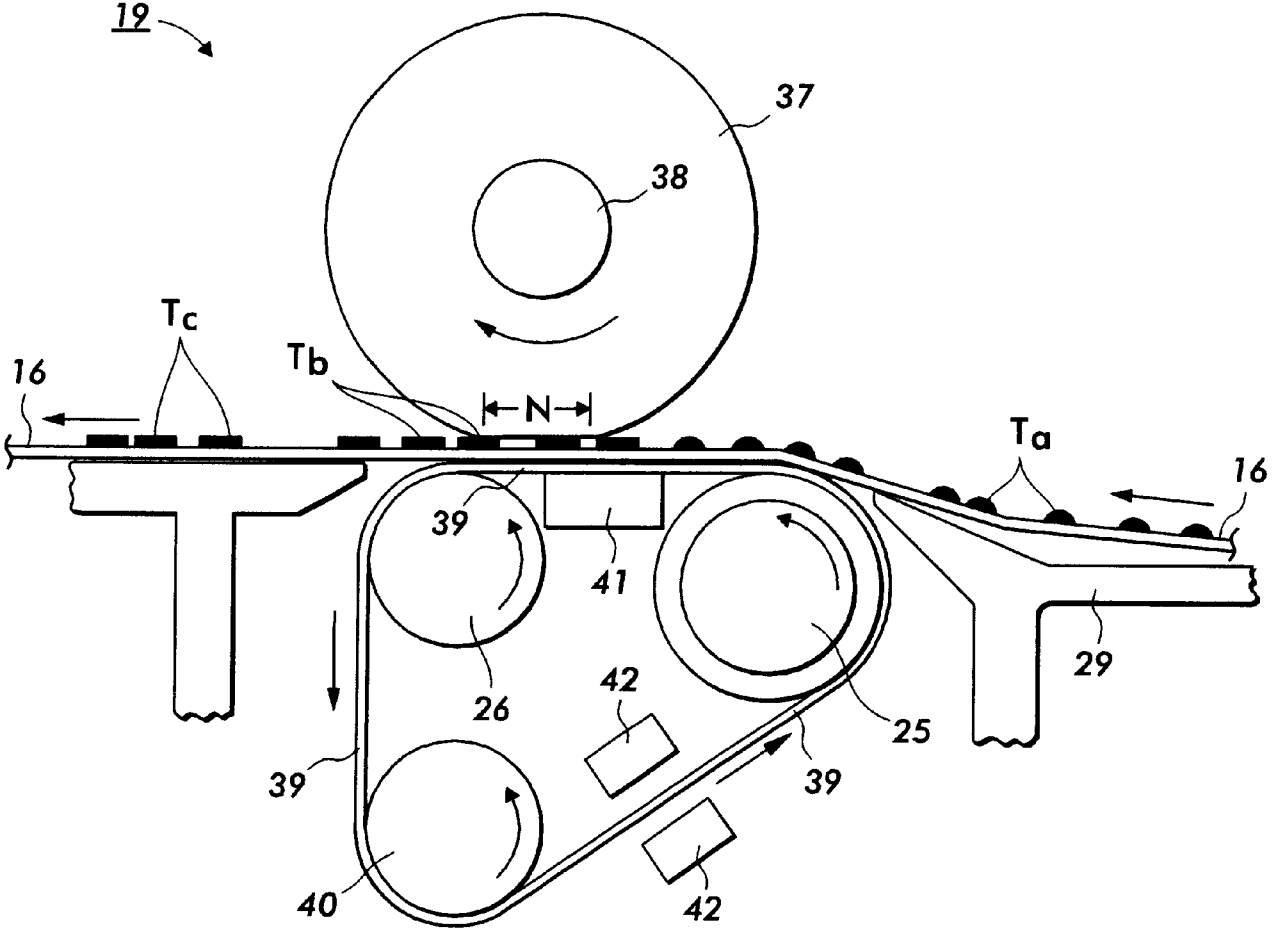
FIG. 3 is a sectional view of a pressure belt in accordance with one embodiment of the present invention.

Another embodiment is depicted in FIG. 3, wherein the fuser member is in the form of a fuser roller 37 having internal heater 38 positioned inside the fuser member. In an optional embodiment, the heating member 38 can be positioned on the outside of the fusing member. Pressure belt 39 cycles around rollers 25, 26, and 40. In this alternative configuration, the toner or other marking material is fused to the copy substrate 16 by fusing roller 37. The load on pad 41 is approximately 1.7 kgf. The polyimide outer layer can be positioned on the fuser roller and/or on the pressure belt. In a specific embodiment, the polyimide outer layer is positioned on the pressure belt.

Figure 4:
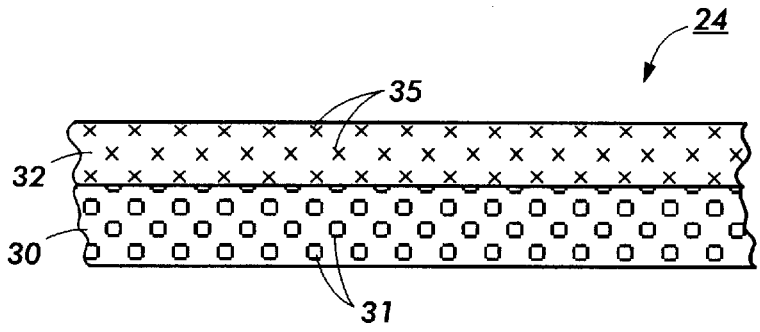
FIG. 4 is a schematic illustration of an embodiment of the present invention, and represents a fuser component having a two-layer configuration.

The fusing component of the present invention can be comprised of at least three different configurations. In one embodiment of the invention, the fusing component is of a two-layer configuration as shown in FIG. 4. FIG. 4 demonstrates fusing component as pressure belt 39. However, it is understood that this and other configurations herein, can be used on any fusing member. Pressure belt 39 comprises substrate 30 having optional fillers 31 dispersed or contained therein. Positioned over the substrate is outer polyimide layer 32 having optional fillers 35 dispersed or contained therein.

Figure 5:
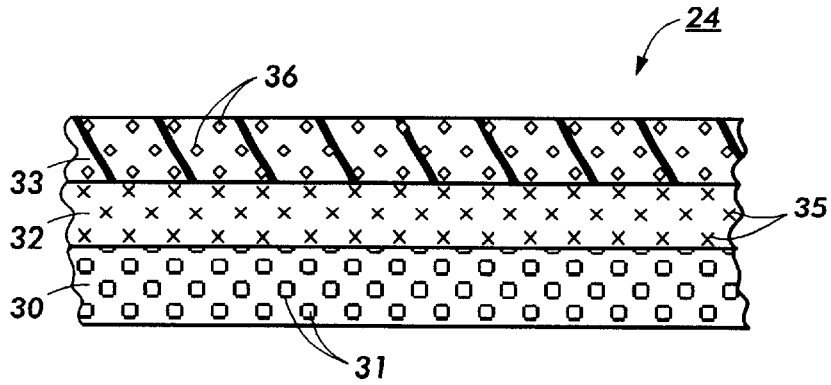
FIG. 5 is an illustration of an embodiment of the present invention, and represents a fuser component having a three-layer configuration, wherein the polyimide layer is the intermediate layer.

FIG. 5 demonstrates an alternative embodiment of the pressure belt 39, which is that of a three layer configuration. FIG. 5 demonstrates substrate 30 having optional fillers 31 dispersed or contained therein. Positioned on the substrate 30 is outer polyimide layer 32 having optional fillers 35 dispersed or contained therein. Positioned over the outer polyimide layer 32 is outer release layer 33 having optional fillers 36 dispersed or contained therein.

Figure 6:
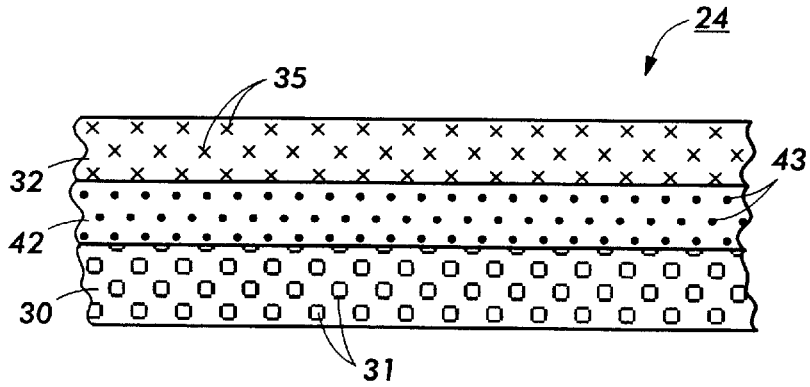
FIG. 6 is an illustration of an embodiment of the present invention, and represents a fuser belt having a three-layer configuration, wherein the polyimide layer is the outermost layer.

An adhesive layer, or other intermediate layer or layers may be present between the substrate and the polyimide outer layer. An example of this embodiment is set forth in FIG. 6, wherein substrate 30 is shown having optional intermediate or adhesive layer 43 thereon. Optional intermediate or adhesive layer 43 may have fillers 44 present therein. Positioned on optional layer 43 is polyimide outer layer 32.

Fillers 31, 35, 36 and 44 are optional, and if present, may be the same or different.

Examples of suitable substrate materials include in the case of roller or film-type substrates, metals such as aluminum, stainless steel, steel, nickel and the like. In the case of film-type substrates, suitable substrates include high temperature plastics that are suitable for allowing a high operating temperature (i.e., greater than about 80 C., preferably greater than 200° C.), and capable of exhibiting high mechanical strength. In embodiments, the plastic has a flexural strength of from about 2,000,000 to about 3,000,000 psi, and a flexural modulus of from about 25,000 to about 55,000 psi. Plastics possessing the above characteristics and which are suitable for use as the substrate for the fuser members include epoxy; polyphenylene sulfide such as that sold under the tradenames FORTRON® available from Hoechst Celanese, RYTON R-4® available from Phillips Petroleum, and SUPEC® available from General Electric; polyimides such as polyamideimide sold under the tradename TORLON® 7130 available from Amoco; polyketones such as those sold under the tradename KADEL® E1230 available from Amoco, polyether ether ketone sold under the tradename PEEK 450GL30 from Victrex, polyaryletherketone, and the like; polyamides such as polyphthalamide sold under the tradename AMODEL® available from Amoco; polyethers such as polyethersulfone, polyetherimide, polyaryletherketone, and the like; polyparabanic acid; and the like; liquid crystalline resin (XYDAR®) available from Amoco; ULTEM® available from General Electric; ULTRAPEK® available from BASF; and the like, and mixtures thereof. Other suitable substrate materials include fluoroelastomers such as those sold under the tradename VITON® from DuPont; silicone rubbers, and other elastomeric materials. The substrate may also comprise a mixtures of any of the above materials.

The substrate as a film, sheet, belt, or the like, has a thickness of from about 25 to about 250, or from about 60 to about 100 micrometers.

The polyimide outer layer material is suitable for allowing a high operating temperature (i.e., greater than about 80, preferably greater than about 200° C. and more specifically, from about 150 to about 250° C.), capable of exhibiting high mechanical strength and optionally possessing tailored electrical properties.

The polyimide can be any suitable high durability polyimide capable of becoming a conductive film upon the addition of electrically conductive particles. The polyimide has the advantages of chemical stability to liquid developer or toner additives, thermal stability for transfix applications and for improved overcoating manufacturing, improved solvent resistance as compared to known materials used for film for transfer components, and improved electrical properties including a uniform resistivity within the desired range.

Suitable polyimides include those formed from various diamines and dianhydrides, such as polyamideimide (for example, Amaco AI-10® from BP Amoco Polymers Inc., Alpharetta, Ga.); polyetherimide; siloxane polyetherimide block copolymer such as, for example, SILTEM® STM-1300 available from General Electric, Pittsfield, Mass.; and the like. Other examples of polyimides include aromatic polyimides such as those formed by the reacting pyromellitic acid and diaminodiphenylether sold under the tradename KAPTON®-type-HN available from DuPont. Another suitable polyimide available from DuPont and sold as KAPTON®-Type-FPC-E, is produced by imidization of copolymeric acids such as biphenyltetracarboxylic acid and pyromellitic acid with two aromatic diamines such as p-phenylenediamine and diaminodiphenylether. Another suitable polyimide includes pyromellitic dianhydride and benzophenone tetracarboxylic dianhydride copolymeric acids reacted with 2,2-bis[4-(8-aminophenoxy)phenoxy]-hexafluoropropane available as EYMYD type L-20N from Ethyl Corporation, Baton Rouge, La. Other suitable aromatic polyimides include those containing 1,2,1',2'-biphenyltetracarboximide and para-phenylene groups such as UPILEX®-S available from Uniglobe Kisco, Inc., White Planes, N.Y., and those having biphenyltetracarboximide functionality with diphenylether end spacer characterizations such as UPILEX®-R also available from Uniglobe Kisco, Inc. Mixtures of polyimides can also be used.

The polyimide is present in the fusing component in an amount of from about 40 to about 100 percent, or from about 60 to about 99 percent, or from about 70 to about 90 volume percent of total solids. Volume percent of total solids as used herein includes the total volume percentage of solids including polymers, conductive fillers, low surface energy fillers, wear resistant fillers, colorant fillers, and any additives in the layer.

A low surface energy filler and/or electrically conductive filler and/or chemically reactive filler may be present in the polyimide outer layer. A low surface energy filler and/or electrically conductive filler may also be present in the substrate and/or adhesive or intermediate layer. Similarly, a low surface energy filler and/or electrically conductive filler may be present in the outer release layer. The filler if present in the outermost layer may aid in release by reacting with any functional groups in any release agent present. The electrically conductive filler may aid in controlling the charge on the fuser member to enhance performance such as non-visual offset or pre-nip toner disturbances or to enable use as a transfix or transfuse member.

Examples of suitable fillers include carbon fillers, metals, metal oxides, doped metal oxides, ceramics, polymer fillers, and the like, and mixtures thereof. Nanofillers are also suitable for use herein, including those having particle sizes of from about from 5 to about 350 nanometers, or from about 20 to about 100 nanometers. Examples of suitable carbon fillers include carbon black (for example, N330® from Cabot, Alpharetta, Ga.) graphite, fluorinated carbon black (for example, ACCUFLUOR® or CARBOFLUOR®), and the like, and mixtures thereof. Examples of metal fillers include aluminum, copper, silver, and the like, and mixtures thereof. Examples of suitable inorganics/ceramics include silicon carbide, silicone nitride, boron nitride, alunimum nitride, boron carbide, tungsten carbide, and the like, and mixtures thereof. Examples of suitable metal oxides include copper oxide, aluminum oxide, zinc oxide, titanium oxide, iron oxide, and the like, and mixtures thereof. Examples of suitable doped metal oxides include antimony doped tin oxide (such as ZELEC®, which is a trademark of DuPont Chemicals Jackson Laboratories, Deepwater, N.J.), aluminum doped zinc oxide, antimony doped titanium dioxide, similar doped oxides, and mixtures thereof. Examples of suitable polymer fillers include polyaniline, polytetrafluoroethylene powder, perfluoroalkoxy powder, ethylene chlorotrifluoroethylene, ethylene tetrafluorethylene, polytetrafluoroethylene perfluoromethylvinylether copolymer, fluorinated ethylene propylene powder, and the like, and mixtures thereof.

In embodiments, more than one type of filler is present in the polyimide outer layer, and/or in any of the other substrate, adhesive or intermediate layer, and/or outer release layer. In embodiments, a carbon filler, metal oxide filler, and/or a polymer filler are present in the polyimide outer layer. In embodiments, a carbon filler is present in an amount of from about 0 to about 20, or from about 5 to about 10 volume percent of total solids. In embodiments, carbon black is the carbon filler. In embodiments, a metal oxide filler is present in an amount of from about 0 to about 20, or from about 5 to about 10 volume percent of total solids. In embodiments, copper oxide is the metal oxide filler. In embodiments, a polymer filler is present in an amount of from about 0 to about 50 percent, or from about 5 to about 40 volume percent of total solids. In embodiments, polytetrafluoroethylene powder is the polymer filler. In an embodiment, from about 5 to about 10 percent carbon black and from about 10 to about 40, or about 20 volume percent polytetrafluoroethylene powder is present in the polyimide outer layer. In an embodiment, from about 5 to about 10 percent copper oxide and from about 10 to about 40, or about 20 volume percent polytetrafluoroethylene powder is present in the polyimide outer layer.

The filler may be present in the polyimide layer in an amount of from about 0 to about 60 percent, or from about 1 to about 40 percent, or from about 10 to about 30 volume percent of total solids. A filler may be present in the substrate in an amount of from about 0 to about 45, or from about 0.01 to about 15, or from about 1 to about 5 volume percent of total solids. In addition, a filler may be present in the outer release layer in an amount of from about 0 to about 55, or from about 10 to about 40, or about 30 volume percent of total solids. Moreover, a filler may be present in the adhesive and/or intermediate layer in an amount of from about 0 to about 40, or from about 0.01 to about 5 volume percent of total solids.

The fusing component member herein may be prepared by preparation of the polyimide, for example, by using the reaction product of a diamine with a dianhydride dissolved in a solvent such as N-methyl-2-pyrrolidone. An appropriate amount of filler is then added and dispersed therein. The filler is added, and the mixture is pebble milled in a roller mill, attritor or sand mill. The poly(amic acid) filler mixture is cast onto a surface, the solvent removed by evaporation, and heated to convert the poly(amic acid) to polyimide.

The outer polyimide layer can be coated on the substrate using any suitable known manner. Typical techniques for coating such materials on the reinforcing member include liquid and dry powder spray coating, dip coating, wire wound rod coating, fluidized bed coating, powder coating, electrostatic spraying, sonic spraying, blade coating, and the like. In an embodiment, the polyimide layer is spray or flow coated to the substrate. The outer polyimide layer can be coated on the substrate to a thickness of from about 5 um to about 50 um, or from about 7 um to about 30 um.

In an embodiment, the outer polyimide layer is modified by any known technique such as sanding, polishing, grinding, blasting, coating, or the like. In embodiments, the outer polyimide layer has a surface roughness of from about 0.02 to about 1.5 micrometers, or from about 0.3 to about 0.8 micrometers. In the three layer embodiment, wherein an optional release layer is provided on the polyimide outer layer, the outer release layer surface can also be roughened in the same or similar manner as just described.

In an embodiment, the polyimide outer layer (in the two-layer configuration) or the outer release layer (in the three layer configuration) has a gardiner gloss of approximately from about 30 to about 100 ggu in order to achieve less than about 5 ggu, or from about 0.1 to about 5 ggu difference on the first side to the second side of the copy substrate for duplex prints.

Examples of suitable intermediate layers include any material capable of forming a conformable layer, such as those polymers listed as suitable for the outer release layer. Examples of suitable adhesive layers are listed below.

The outer release layer, if present, can comprise a low surface energy material such as silicone rubber, fluoropolymer, urethane, acrylic, titamer, ceramer, hydrofluoroelastomer such as volume grafted fluoroelastomers, or mixtures, copolymers, or polymers thereof.

Examples of suitable fluoropolymers include fluoroelastomers such as copolymers and terpolymers of vinylidenefluoride, hexafluoropropylene and tetrafluoroethylene, which are known commercially under various designations as VITON A®, VITON E®, VITON E60C®, VITON E45®, VITON E430®, VITON 910®, VITON GH®, VITON B50®, and VITON GF®. The VITON® designation is a Trademark of E. I. DuPont de Nemours, Inc. Other commercially available materials include FLUOREL 2170®, FLUOREL 2174®, FLUOREL 2176®, FLUOREL 2177® and FLUOREL LVS 76® FLUOREL® being a Trademark of 3M Company. Additional commercially available materials include AFLAS™ a poly(propylene-tetrafluoroethylene) and FLUOREL II® (LII900) a poly(propylene-tetrafluoroethylene vinylidenefluoride) both also available from 3M Company, as well as the Tecnoflons identified as FOR-60KIR®, FOR-LHF®, NM® FOR-THF®, FOR-TFS®, TH®, TN505® available from Montedison Specialty Chemical Company.

Two specific known fluoroelastomers are (1) a class of copolymers of one or more of, or any combination of vinylidenefluoride, tetrafluoroethylene and hexafluoropropylene known commercially as VITON A® and (2) a class of terpolymers of vinylidenefluoride, hexafluoropropylene, and tetrafluoroethylene known commercially as VITON B®. VITON A®, and VITON B®, and other VITON® designations are trademarks of E. I. DuPont de Nemours and Company.

In another embodiment, the fluoroelastomer is a tetrapolymer having a relatively low quantity of vinylidenefluoride. An example is VITON GF®, available from E. I. DuPont de Nemours, Inc. The VITON GF® has 35 weight percent of vinylidenefluoride, 34 weight percent of hexafluoropropylene and 29 weight percent of tetrafluoroethylene with 2 weight percent cure site monomer. The cure site monomer can be those available from DuPont such as 4-bromoperfluorobutene-1,1,1-dihydro-4-bromoperfluorobutene-1,3-bromoperfluoropropene-1,1,1-dihydro-3-bromoperfluoropropene-1, or any other suitable, known, commercially available cure site monomer.

In another embodiment of the invention, the fluoroelastomer is a volume grafted elastomer. Volume grafted elastomers are a special form of hydrofluoroelastomer and are substantially uniform integral interpenetrating networks of a hybrid composition of a fluoroelastomer and a polyorganosiloxane, the volume graft having been formed by dehydrofluorination of fluoroelastomer by a nucleophilic dehydrofluorinating agent, followed by addition polymerization by the addition of an alkene or alkyne functionally terminated polyorganosiloxane and a polymerization initiator.

Volume graft, in embodiments, refers to a substantially uniform integral interpenetrating network of a hybrid composition, wherein both the structure and the composition of the fluoroelastomer and polyorganosiloxane are substantially uniform when taken through different slices of the fuser member. A volume grafted elastomer is a hybrid composition of fluoroelastomer and polyorganosiloxane formed by dehydrofluorination of fluoroelastomer by nucleophilic dehydrofluorinating agent followed by addition polymerization by the addition of alkene or alkyne functionally terminated polyorganosiloxane. Examples of specific volume graft elastomers are disclosed in U.S. Pat. No. 5,166,031; U.S. Pat. No. 5,281,506; U.S. Pat. No. 5,366,772; and U.S. Pat. No. 5,370,931, the disclosures of which are herein incorporated by reference in their entirety.

Other polymers useful as the outer release layer include silicone rubbers such as silicone rubbers, including fluorosilicones, phenyl silicones, silicone blends, and the like. Additional polymers useful as the outer release layer include fluoropolymers such as polytetrafluoroethylene (PTFE), fluorinated ethylenepropylene copolymer (FEP), polyfluoroalkoxy polytetrafluoroethylene (PFA Teflon), ethylene chlorotrifluoro ethylene (ECTFE), ethylene tetrafluoroethylene (ETFE), polytetrafl uoroethylene perfluoromethylvinylether copolymer (MFA), and the like. These polymers, together with adhesives, can also be included as intermediate layers.

The outer release layer can be coated to the polyimide outer layer using any known, suitable technique. In an embodiment, the outer release layer is spray or flow coated to the polyimide outer layer. The outer release layer can be coated on the outer polyimide layer to a thickness of from about 1 to about 50, or from about 5 to about 20 um.

The low surface energy material is present in the outer release layer in an amount of from about 0 to about 40 percent, or from about 10 to about 30 percent, or about 20 volume percent of total solids.

The static friction as measure against coated paper of the polyimide layer, over a substrate or over adhesive/intermediate layer may be less than about 0.45, or from about 0.01 to about 0.45, or less than about 0.24 or from about 0.1 to about 0.24. The static friction at these numbers would be enough to eliminate all wave defects.

The fusing component employed for the present invention can be of any suitable configuration. Examples of suitable configurations include a sheet, a film, a web, a foil, a strip, a coil, a cylinder, a drum, a roller, an endless strip, a circular disc, a belt including an endless belt, an endless seamed flexible belt, an endless seamless flexible belt, an endless belt having a puzzle cut seam, and the like.

Optionally, any known and available suitable adhesive layer may be positioned between the polyimide outer layer and the substrate, and/or between the outer polyimide layer and the outer release layer. Examples of suitable adhesives include silanes such as amino silanes (such as, for example, A1100 from OSI Specialties, Friendly West Virginia), titanates, zirconates, aluminates, and the like, and mixtures thereof. In an embodiment, an adhesive in from about 0.25 to about 10 percent solution, can be wiped on the substrate. The adhesive layer can be coated on the substrate, or on the polyimide outer layer, to a thickness of from about 2 to about 2,000 nanometers, or from about 2 to about 500 nanometers. The adhesive can be coated by any suitable, known technique, including spray coating or wiping.

Specific embodiments of the invention will now be described in detail. These examples are intended to be illustrative, and the invention is not limited to the materials, conditions, or process parameters set forth in these embodiments. All parts are percentages by volume of total solids unless otherwise indicated.

EXAMPLES

Example 1

Polyimide Pressure Belt with Perfluoroalkoxy Coating

A 75 um polyimide belt coated with about 25 um of cured perfluoroalkoxy was obtained from Fuji Xerox.

Example 2

Polyimide Pressure Belt with Fluoroelastomer Intermediate Layer and Filled Polyamideimide Coating A standard Docucolor (obtained from Fuji Xerox Corporation) pressure belt comprising 75 um of polyamideimide substrate having an intermediate layer of 180 um of a fluoroelastomer, was coated with XYLAN® 1010 (polyamideimide having about 40 percent by volume of polytetrafluoroethylene filler) with the addition of about 1 percent by volume copper oxide.

The sample was prepared a follows. About 1 percent by volume copper oxide (Nanophase Technology, Burr Ridge, Ill.) was ball milled with ceramic media for about 18 hours minimum at 10 percent solids in acetone. About 60 volume percent of the XYLAN® 1010 was mixed on a roll mill for about 10 minutes minimum until dispersed. The copper oxide mixture was then added to the XYLAN® 1010 at the rate of about 1 percent copper oxide by volume of XYLAN® 1010 solids. The material was diluted by approximately 30 percent with NMP and xylene in a 2:1 mixture. The surface was then wiped with hexane followed by isopropyl alcohol. The coating mixture was then sprayed onto the surface of the pressure belt to a thickness (dry) of from about 7 to about 15 um. The pressure belt was subsequently baked for about 20 minutes at about 450° F.

Example #3

Polyimide Pressure Belt with Filled Polyamideimide Coating

A polyimide belt was prepared in accordance with the procedure outlined in Example 2, except that the fluoroelastomer intermediate layer was not coated on the substrate and the coating was baked at 650° F. for about 20 minutes. This resulted in a polyimide substrate coated with XYLAN® 1010 with 1 percent copper oxide.

Example #4

Polyimide Pressure Belt with Polyamideimide Coating

A polyimide belt was prepared as in Example 3, except that the copper oxide filler was not added to the polyamideimide coating.

Example #5

Polyimide Pressure Belt with Filled Polyamideimide Coating

A polyimide belt was prepared as in Example 3, except that Amoco AI-10 was used in place of the XYLAN® 1010 coating. The AI-10 was dissolved in equal amounts of NMP and acetone.

Example #6

Polyimide Pressure Belt with Filled Polyimide Coating

A belt was prepared in accordance with Example 4, except that the material coated was a 6:1 mixture of XYLAC® 4100/870-E8186A and XYLAC® 4100/870-D3534. The coated belt was placed on a mandrel, rotated, and the surface was sanded with 15 um aluminum oxide 3M imperial microfinishing film. The mandrel/belt was then rotated and polished with "fine" 3M Scotchbrite

Example #7

Testing of the Belts

The belts described above were run in a Docucolor 2060 (Xerox Corporation) and checked for offset on the prints or dirt build up on the belt, which would indicate release failure had occurred. The belts were also checked for visible lines in the prints caused by stripper finger wear on the belt approximately every 10,000 prints. The occurrence of stripper finger marks in the prints or offset was considered the failure point for the belt. The results of testing the above samples are set forth below in Table I.

TABLE I

| Example No. | Release | Finger Marks | Copy Count |
|---|---|---|---|
| 1 | OK | Copy defect | 30K |
| 2 | OK | No copy defect | 80K suspended |
| 3 | OK | No copy defect | 120K suspended |
| 4 | OK | No copy defect | 100K suspended |
| 5 | Offset | No copy defect | 80K |
| 6 | OK | No copy defect | 100K suspended |

The results above demonstrate that the belts made with an outer layer comprising a polyimide showed superior results in that dirt did not build up on the belt, no copy quality defects were observed, and copy count was good. These results are compared to a belt comprised of an outer fluoropolymer layer. This belt (Sample 1) demonstrated a copy quality defect at less than 30K copies.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims.

We claim:

1. A fusing apparatus comprising a heated fuser member and a pressure belt positioned so as to allow a developed image to be fused to a copy substrate by passing said copy substrate having said developed image thereon, between said heated fuser member and said pressure belt, wherein said pressure belt comprises a polyimide substrate, and thereover, an outer layer comprising a polyimide.

2. The pressure belt of claim 1, wherein said polyimide substrate comprises a filler.

3. The pressure belt of claim 2, wherein said filler is selected from the group consisting of carbon fillers, metal fillers, ceramic fillers, metal oxide fillers, doped metal oxide fillers, polymer fillers, and mixtures thereof.

4. The pressure belt of claim 3, wherein said filler is a metal oxide selected from the group consisting of copper oxide, aluminum oxide, titanium oxide, zinc oxide, iron oxide, and mixtures thereof.

5. The pressure belt of claim 1, wherein said polyimide of said polyimide substrate is selected from the group consisting of aromatic polyimides, polyamideimide, polyetherimide, siloxane polyetherimide block copolymers, and mixtures thereof.

6. The pressure belt of claim 5, wherein said polyimide is a polyamideimide.

7. The pressure belt of claim 1, wherein said polyimide outer layer comprises a filler.

8. The pressure belt of claim 7, wherein said filler is selected from the group consisting of carbon fillers, metal fillers, ceramic fillers, metal oxide fillers, doped metal oxide fillers, polymers fillers, and mixtures thereof.

9. The pressure belt of claim 8, wherein said filler is a metal oxide selected from the group consisting of copper oxide, aluminum oxide, titanium oxide, zinc oxide, iron oxide, and mixtures thereof.

10. The pressure belt of claim 9, wherein said filler is copper oxide.

11. The pressure belt of claim 8, wherein said filler is a polymer filler selected from the group consisting of polytetrafluoroethylene powder, polyaniline, perfluoroalkoxy powder, ethylene chlorotrifluoroethylene, ethylene tetrafluoroethylene, polytetrafluoroethylene-perfluoromethylvinylether copolymer, fluorinated ethylene propylene powder, and mixtures thereof.

12. The pressure belt of claim 11, wherein said polymer filler is polytetrafluoroethylene powder.

13. The pressure belt of claim 7, wherein said filler is present in the polyimide outer layer in an amount of from about 1 to about 40 volume percent of total solids.

14. The pressure belt of claim 13, wherein said filler is present in an amount of from about 10 to about 30 volume percent of total solids.

15. The pressure belt of claim 1, further comprising an outer release layer provided on said polyimide outer layer.

16. The pressure belt of claim 15, wherein said outer release layer comprises a material selected from the group consisting of fluoropolymers, silicone rubbers, urethanes, acrylics, titamers, creamers, hydrofluoroelastomers, and mixtures thereof.

17. The pressure belt of claim 15, wherein said outer release layer further comprises a filler selected from the group consisting of carbon fillers, metal fillers, metal oxide fillers, ceramics, doped metal oxide fillers, polymer fillers, and mixtures thereof.

18. The pressure belt of claim 1, wherein said polyimide outer layer has a surface roughness of from about 0.02 to about 1.5 micrometers.

19. The pressure belt of claim 18, wherein said surface roughness is from about 0.3 to about 0.8 micrometers.

20. The pressure belt of claim 1, wherein an intermediate layer is positioned between said polyimide substrate and said outer polyimide layer.

21. The pressure belt of claim 20, wherein said intermediate layer is a conformable layer.

22. The pressure belt of claim 20, wherein said intermediate layer is an adhesive layer.

23. A fusing apparatus comprising a heated fuser member and a pressure belt positioned so as to allow a developed image to be fused to a copy substrate by passing said copy substrate having said developed image thereon, between said heated fuser member and said pressure belt, wherein said pressure belt comprises a polyimide substrate and thereover, an outer layer comprising a polyimide and filler, wherein said filler is selected from the group consisting of polytetrafluoroethylene powder, copper oxide, carbon black, and mixtures thereof.

24. An image forming apparatus for forming images on a recording medium comprising:

a charge-retentive surface to receive an electrostatic latent image thereon;

a development component to apply toner to said charge-retentive surface to develop an electrostatic latent image to form a developed image on said charge retentive surface;

a transfer film component to transfer the developed image from said charge retentive surface to a copy substrate; and a fusing apparatus comprising a heated fuser member and a pressure belt positioned so as to allow said developed image to be fused to said copy substrate by passing said copy substrate having said developed image thereon, between said heated fuser member and said pressure belt, wherein said pressure belt comprises a polyimide substrate, and thereover an outer layer comprising a polyimide.

* * * * *